United States Patent [19]

Mathison

[11] Patent Number: 4,697,810

[45] Date of Patent: Oct. 6, 1987

[54] BASKETBALL TRAINING DEVICE

[76] Inventor: John W. Mathison, 8780 E. McKellips, Unit #116, Scottsdale, Ariz. 85257

[21] Appl. No.: 901,894

[22] Filed: Aug. 28, 1986

[51] Int. Cl.[4] ..... A63B 69/00

[52] U.S. Cl. ..... 273/1.5 A

[58] Field of Search ..... 273/1.5 R, 1.5 A

[56] References Cited

U.S. PATENT DOCUMENTS 3,799,543 3/1974 Steele, Jr. ..... 273/1.5 A 3,814,421 6/1974 Spier, Jr. ..... 273/1.5 A 3,901,506 8/1975 Caveney ..... 273/1.5 A 4,595,199 6/1986 Offutt ..... 273/1.5 A

*Primary Examiner*—Paul E. Shapiro

*Attorney, Agent, or Firm*—Richard R. Mybeck

[57] ABSTRACT

A training device for practicing shooting baskets in association with a standard basketball goal. A paneled enclosure is supported relative to the in-play area of the goal, the panels being selectively pivotable between an open and closed position. Beneath the enclosure is a funnel shaped collection device which channels balls to a return chute to direct the basketball back to the practicing player.

20 Claims, 5 Drawing Figures

FIG. 1
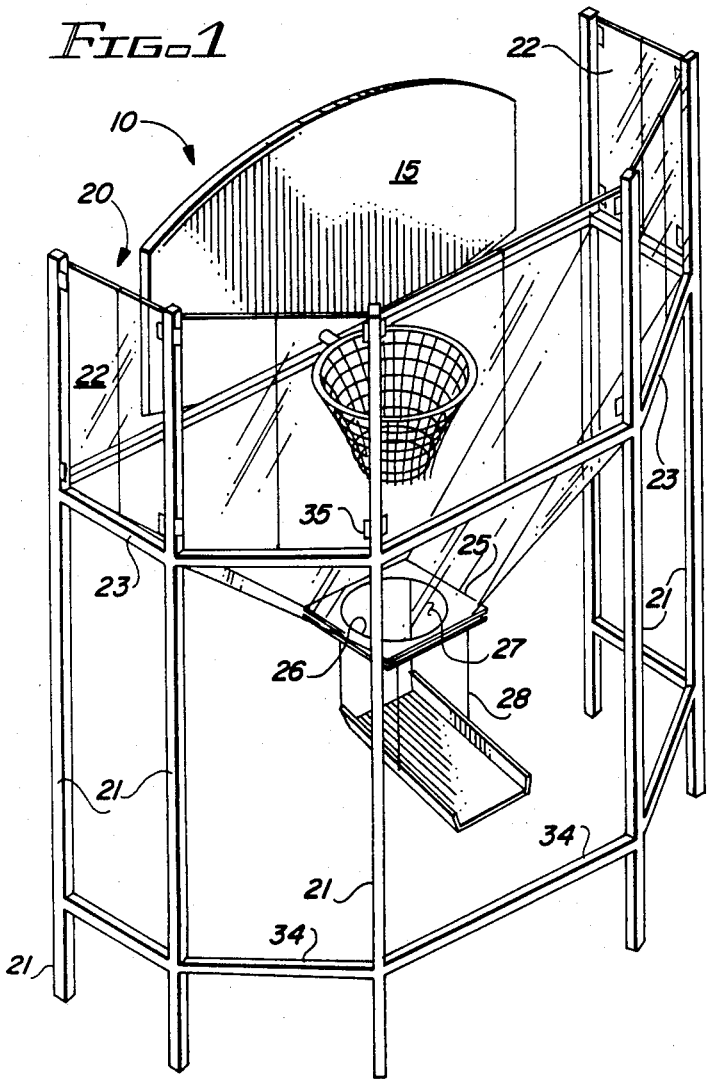
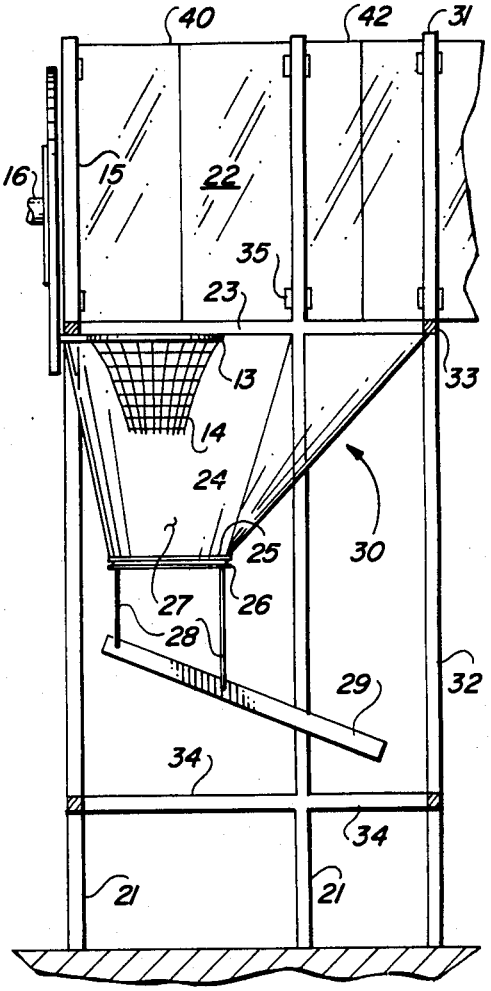
FIG. 2
FIG. 4
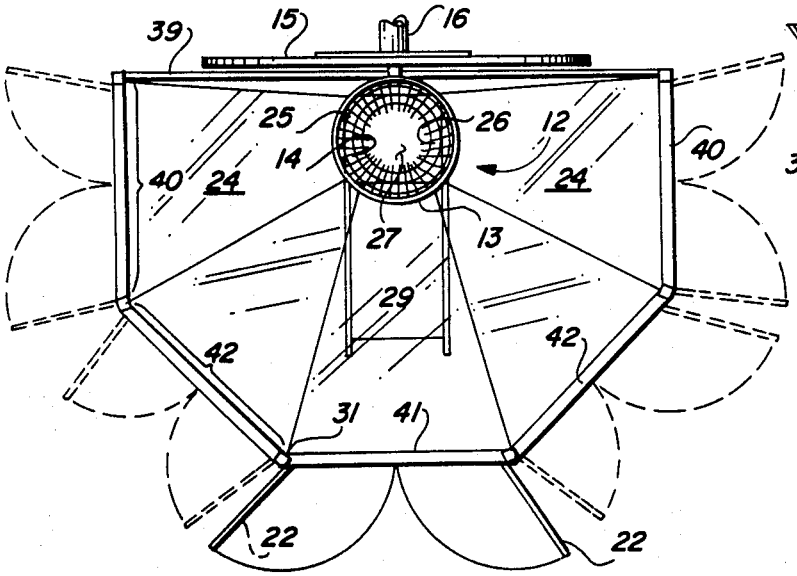
FIG. 3
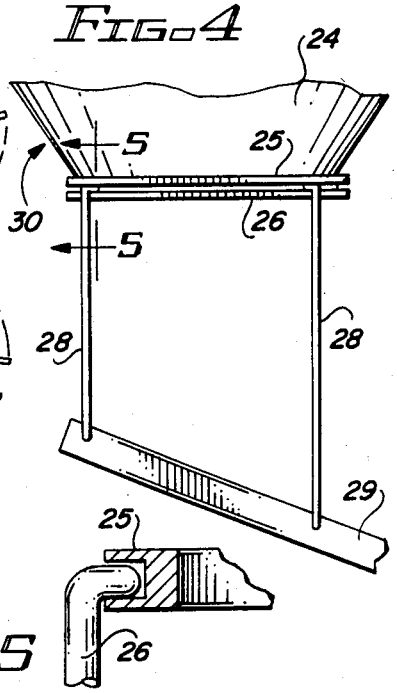
FIG. 5

BASKETBALL TRAINING DEVICE

INTRODUCTION

The present invention relates to a training device and, more particularly, to a novel device having a segmented enclosure whereby an erstwhile basketball player can repeat practice shots from a preselected direction relative to the hoop, have the basketball quickly returned to him to facilitate repetition, and thereafter, when desired, quickly change the angle of the practiced shot by simple movement of preselected portions of the device without relocating the principal structure thereof.

BACKGROUND OF THE INVENTION

Basketball is an American game; its standard terminology is used throughout. Dr. Naismith is commonly given credit for inventing basketball when he first mounted a peach basket on a wall and threw a ball into it. Originally a peach basket was mounted on each end of a court with an attendant standing by to remove the ball from the basket (the probable source for the term "basket") and return the basket ball to the court for further play. Since that time, there has been a never-ending search for means and methods to efficiently and economically collect the ball from the basket and return it to play after each shot.

The common picture of Indiana farm boys shooting at a hoop mounted to a barn, or their city cousins shooting at a hoop mounted to a garage has certain drawbacks. First, after passing through the net for a score, the ball inevitably tends to remain more or less beneath the hoop. Second, so-called "air balls", i.e., those wild shots which totally miss hoop and backboard, tend to hit the building upon which the hoop is mounted which does not please the owner of the building. Third, missed shots bounding off the hoop or the backboard tend to go in unpredictable directions and rarely return to the exact location desired. An additional problem arises when the basketball goal, i.e., a ringed hoop attached to a vertically disposed backboard, is mounted on a pole to avoid having air balls hit a building. Then an air ball has no structure to hit and tends to travel past the goal until it hits some restraint, which may be a very long way away from the goal.

The defects in these prior set ups are obvious. One or more chasers are required if concentrated beneficial shooting practice is to occur. Even then, the ball tends to get away every so often and practice is delayed unless an inordinate supply of extra balls is available. Further, basic human nature dictates that everyone wants to be a "shooter" while no one wants to be a "chaser". The combination of human and mechanical problems tends to make the efficient and concentrated practice of shots from preselected positions or directions virtually impossible.

Various devices have been suggested by the art to overcome these problems. Several of the devices taught have overcome some of the problems described above, but none have heretofore provided all of the necessary characteristics and flexibility to be truly useful in solving the practice problem. For instance, Shisoff, U.S. Pat. No. 1,924,757 disclosed an amusement apparatus for shooting baskets at an amusement park. It tended somewhat to corral errant shots by means of fixed barriers placed on both sides of and extending several feet in front of the basket. The barriers allowed only shots from dead ahead of the basket to be taken. Further, the device does not immediately return the ball to the shooter after the shot. After each shot, balls are accumulated until the predetermined number has been gathered.

McNabb, U.S. Pat. No. 3,776,550 disclosed a basketball retrieval and return device which also had several drawbacks. First, the shooter can shoot from only a small limited fixed area due to the nature of the ball return device. The ball return path is in no way reciprocal or parallel to the shot path. Second, many errant shots bounced off the rim or backboard and easily avoided the retrieval and return mechanism altogether, as the only retrieval mechanism is a large collector to retrieve those shots that fortuitously enter it. The device has no means to control and/or redirect rebounds and other missed shots.

While Spier U.S. Pat. No. 3,814,921 provided a device having a directable return means for good shots, several problems remained unresolved. First Spier provided no means for collecting missed shots. Second, the utility of the return chute was distinctly limited in that it was designed to return balls to the designated player at a predefined distance from the basket (15 feet); and the directional control of the chute required adjustment just below hoop level, and inconvenient position for most users of more normal stature.

Caveney, U.S. Pat. No. 3,901,506 taught a device which was similarly limited in that the ball return means was attached to a fixed location on the basketball court floor. Further, the rebound collection means was so located that it could interfere with shots that would otherwise hit the hoop and/or backboard. Additionally, the rebound collection means could easily and even intentionally cause a missed shot to bound further from the shooter than the rebound itself would have gone had the device not been installed. Finally, the rebound collection means of Caveney were visually distracting. The device thereby interfered with the overall purpose of the practice session and the reason for having the device in the first place.

Therefore the problem of providing a means whereby a designated player may obtain concentrated practice in shooting basketballs at a hoop from a number of easily and quickly changed positions and directions relative thereto while having the ball quickly and conveniently returned to said player without extraneous distractions, remains; it is toward the solution of this problem to which the present invention is directed.

SUMMARY OF THE INVENTION

The present invention relates to a basketball training (retrieval and return) device which allows a player to shoot a basketball at a hoop from a preselected direction, and have the ball returned to the player after made shots and after most missed shots. Further the player can quickly and easily adjust the device so that a different desired direction or location can be readily selected and used without altering the position of the device itself.

More particularly, the present invention relates to a device which is positionable relative to a conventional basketball goal and comprises: support members; paneled enclosure means operatively attached to said support members, the panels being selectively opened or closed to admit or retain a shot therewithin; collection means depending from said support members and subposed relative to the enclosure means to collect all made and most missed shots passing therethrough; and return means operatively associated with and depending from the collection means for directing the collected basketball in a preselected direction back to the designated player.

As will hereafter become apparent, the present invention provides a device which solves the prior art problems, e.g., interference, visual distraction, difficulty of adjustment, limited use, and the like, in a remarkably unexpected fashion.

Accordingly, a prime object of the present invention is to provide a novel and unique bsketball training device which enables an individual to practice a particular basketball shot and have the basketball returned to a preselected location or direction.

A further object of this invention is to provide a novel and unique portable basketball training device which minimizes for the user the visual distractions heretofore prevalent in similar prior art devices.

Another object of the present invention is to provide a novel and unique basketball training device which enhances a player's concentration by substantially eliminating the distracting need to stop and pursue errant returns.

A still further object of the present invention is to provide a basketball training device in which all made shots and substantially all missed shots are quickly returned to the shooter.

Still another object of the present invention is to provide a basketball training device whereby set multiplayer strategies an be repeatedly practiced by opening one or more selected panels of the enclosure without significant adverse effects upon the collection function of the device.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF DRAWINGS

In the drawings:

FIG. 1 is an isometric frontal view of a baksetball training device embodying the present invention;

FIG. 2 is a side elevation of the device of FIG. 1;

FIG. 3 is a plan view of the device of FIG. 1 with various panels open (in phantom) to demonstrate the versatility of the present invention;

FIG. 4 is a fragmented view of the collector system and the adjustable return chute of the device of FIG. 1 embodying the present invention; and FIG. 5 is a cross section taken along line 5—5 of FIG. 4.

DESCRIPTION OF PREFERRED EMBODIMENTS

Referring to FIGS. 1-3 of the drawing, a device embodying the present invention is identified by the numeral 10 and is shown in operative association with a standard basketball goal 12 comprising a hoop 13 having a conventional basketball net 14 depending therefrom and operatively supported by a backboard 15. Support member 16 is attached to the back of backboard 15 and extends therefrom to support backboard 15 to an accompanying structure (not shown) which can be a roof beam of a wall (in an indoor installation) or a post (either indoors or outdoors) as is well known. When a post is employed it can be imbedded into the playing surface or placed within a weighted base as the exigencies of a particular set up may require.

Device 10, as shown, comprises an enclosure assembly 20 which, as will hereafter appear, provides the means whereby the basketball is collected and returned. While enclosure assembly 20 may be arranged to define a number of useful configurations depending on the spotting of vertical frame members 21 it is shown in a convenient formation comprising five-eighths of an octagon. Any convex configuration is acceptable wherein the side segments 40 as defined below on each side of the enclosure assembly 20 closest to the plane of the backboard 15 with which the device 10 is at that time associated are generally perpendicular to the plane of backboard 15; the front segment 41 which is the segment furthest from the plane of backboard 15 is both generally parallel thereto and so positioned that the hoop 13 is between segment 41 and backboard 15, and the center of segment 41, hoop 13 and backboard 15 are substantially in alignment normal to the plane of backboard 15. A plurality of intermediate segments 42 are operatively interposed between the segment 41 and the segments 40 on each side of the enclosure assembly 20. However the enclosure assembly 20 need not be symmetrical. Further, the segments 40, 41 and 42 may each have different widths if desired. Each segments 40, 41 and 42 is defined by and between an adjacent pair of the plurality of vertical frame members 21 disposed in spaced relationship to each other in the perimeter of enclosure assembly 20. Enclosure assembly 20 could be disposed in the shape of a simple or composite curve as well as a portion of a regular or irregular convex polygon.

In one practice of the present invention, each vertical frame member 21 will be formed of two pieces, an upper or panel support portion 31 and a lower support portion 32 detachably secured to each other by socket means 33. Vertical frame members 21 are operatively spaced to support and define enclosure assembly 20. A plurality of enclosure panels 22 of substantially rectangular shape, are pivotally attached to each panel support portion 31, as with hinges 35.

The location of panels 22 and the general shape of enclosure assembly 20 are further defined by the coaction of upper cross frame members 23 with the vertical frame members 21 as each cross frame member 23 interconnects a different pair of adjacent vertical frame members 21. Upper cross frame members 23 define the lower limits of the space within which basketballs are contained by the coaction of enclosure panels 22 and backboard 15. Each upper cross frame member 23 is fixedly attached to the adjacent vertical frame members 21. All upper cross frame members 23, which define the lower limits of enclosure panels 22 are further positioned at such a height, approximately one inch above the height of the hoop, so as to be visually non-distracting. A horizontal brace member 39 extending across the base of enclosure assembly 20 about 8 inches lower than cross frame members 23 is positioned to stabilize device 10 and permit the device 10 to be readily moved under an existing goal installation without interference or bumping. Lower cross frame members 34 interconnect vertical frame member 21 to also stabilize the enclosure assembly 20.

A ball return means 30 formed of removable collection panels 24, an exit frame 25 having a slotted rim 26 defining an exit hole 27, support means 28 and directable return chute 29, as will be more fully described, is mounted within enclosure assembly 20. As shown in FIGS. 1–3, each collection panel 24 is disposed so that its top edge is operatively connected to an adjacent upper cross frame member 23 and its bottom edge is operatively connected to exit frame 25. Exit frame 25 is supported by said collection panels 24 and circumscribes and supports rotatable rim 26. Rotatable rim 26 circumscribes exit hole 27. The upper ends of support means 28 are attached in operatively spaced arrangement to the lower flange of rotatable rim 26. Return chute 29 depends from support means 28. Return chute 29 is suspended in a downward sloping manner so that its upper portion is always operatively beneath exit hole 27 regardless of the direction in which chute 29 is pointed to direct the return of the basketball. A basketball downwardly passing through exit hole 27 will first impact the upper portion of chute 29, then travel down the lower portion of chute 29, and return to the designated play.

Ideally, removable enclosure panels 22 and collection panels 24 are constructed from sturdy transparent, shatter-proof material such as Lucite® to minimize visual distractions. However, any non-breakable material could be used. Even opaque plastics, as well as sheet metal would meet the structural requirements of the device 10 although such materials would be visually distracting to the user. Canvas or other suitable material could be used in collection panels 24.

Vertical frames 21 and the other structural frame and bracing members herein are preferably constructed from wood 2"×4"'s, plastic tubes or other suitable material. Suitable materials for the exit frame 25 rotatable rim 26 and return chute 29 include sheet aluminum or high-strength plastic. Ideally, support means 28 are constructed from metal rods or other suitable material.

Alternative structures based upon this invention would be obvious to one skilled in the art. Regardless of the particular alternative chosen, the device would be prepared for use in the same manner, to wit, device 10 is set up in position about a basketball goal 12. The designated player selects a direction from which it is desired to practice shooting a basketball. The portions of segments 40, 41 and 42 of enclosure assembly 20 that could interfere with a shot from the selected direction which would otherwise pass through hoop 13 are uncovered by opening enclosure panels 22 and/or removing panel support members 31 with enclosure panels 22 attached thereto from the position atop support member 32. Further, any opened enclosure panel 22 is placed so that it will not interfere with the use of the device 10 and may further tend to reflect bad shots that do not enter the enclosure assembly 20 back generally towards the shooter. Rotatable rim 26 is moved so that a basketball passing downwardly through hole 27 will impact the upper portion of return chute 29, and roll down return chute 29 and return to the designated player in a direction generally reciprocal to that which would be followed by a shot taken by the designated player.

The device 10 is used as follows: the designated player shoots the basketball; if the shot is good, the basketball will pass downwardly through hoop 13, net 14 and exit hole 27, and then impact at the upper portion of chute 29, move down chute 29, and travel back towards the designated player. If the basket is not good, but enters the space defined by enclosure assembly 20, three things may happen. First, the basketball may bounce off of hoop 13 and/or backboard 15 and pass back through an uncovered portion of segment 40, 41 or 42 of enclosure 20; in that event, the missed shot will return to the designated player as intended. Second, the basketball may bounce in such a manner or height to pass over the top of the panels 22 or backboard 15 and thus leave the area defined by the enclosure assembly 20. With the use of proper dimensions, these events will be relatively rare. Third, the basketball will remain in the enclosure. In that case, the baksetball will eventually impact one or more of the collection panels 24, by gravity travel down said panels to exit hole 27, impact chute 29 and then behave as if the shot had been made.

Similarly, if the device is used to simulate a multi-player situation, the ball starts out in the hands of the designated player. Chute 29 is aimed towards the designated player. The selected portions of segments 40, 41 or 42 of the enclosure assembly 20 are opened to admit shots from the directions of all players. At a selected moment the designated player either shoots or passes the ball to another player who then passes or shoots the ball. The process continues until a shot is taken. A missed shot which leaves the enclosure 20 through an uncovered portions of segments 40, 41 or 42 can be rebounded by a non-designated player and then be passed directly to the designated player. In either mode all shots retained within the enclosure assembly 20 are returned back to the designated player in the manner described above for single player use of the device 10.

In either single of multi-player mode the covered and uncovered portions of segments 40, 41 and 42 of enclosure 20 can be easily changed by opening or closing selected enclosure panels 22 and installing and removing panel support 31 so that the designated player and all players involved may be at any in-play direction from the hoop 13. Similarly the direction of chute 29 can easily be adjusted to return the ball to the designated player at any in-play direction from the hoop 13.

From the foregoing it is readily apparent that the device herein described and illustrated achieves all of the foregoing objectives in a remarkably unexpected manner. It is of course understood that such modifcation, adaptation and alteration as may readily occur to the artisan when confronted by this disclosure are intended within the spirit of the invention which is limited solely by the scope of the claims appended hereto.

Accordingly, what is claimed is:

1. A basketball training device adapted for use by a designated player in association with an existing basketball hoop and backboard, said device comprising: support means; enclosure means attached to said support means and coacting with said backboard to define a space about said hoop, said enclosure means having a plurality of panels mounted therein in pivotal relationship to said support means, said panels being selectively pivotable between a first open and a second closed position to respectively permit or deny passage therethrough; collection means attached to and depending from said support means beneath said enclosure means to receive therein a basketball passing into and remaining within said space until drawn by gravity from said space; and adjustable return means operatively disposed beneath said collection means for receiving a basketball therefrom and directing said basketball to said designated player.

2. A device according to claim 1 in which each said panel is formed of shatterproof material.

3. A device according to claim 2 in which each said panel is transparent.

4. A device according to claim 3 in which said collection means is transparent.

5. A device according to claim 1 in which said support means comprises a plurality of spaced generally vertical support members, a plurality of upper and lower cross frame members, one of said upper members and one of said lower members being mounted transversely between each adjacent pair of vertical support members.

6. A device according to claim 5 in which each said panel is formed of shatterproof material.

7. A device according to claim 6 in which each said panel is transparent.

8. A device according to claim 7 in which said collection means is transparent.

9. A device according to claim 5 in which each said vertical support member comprises an upper portion, a lower portion, and socket means for axially conjoining said upper portion with said lower portion and removably securing it thereto.

10. A device according to claim 9 in which each of said panels is hinged to an adjacent one of said upper portion of said vertical support member.

11. A device according to claim 10 in which each said panels engages an adjacent one of said upper cross frame members when said segment is in said closed position.

12. A device according to claim 11 in which each said panel is formed of shatterproof material.

13. A device according to claim 12 in which each said panel is transparent.

14. A device according to claim 13 in whcih said collection means is transparent.

15. A device according to claim 5 in which said collection means has a plurality of side portions, each of which is secured to and converginingly depends from an adjacent one of said upper cross frame members to form a mouth, an exit frame member attached to said side portions and having an opening defined therethrough providing egress therefrom.

16. A device according to claim 15 in which said exit frame member has an adjustable rim defined therewith in circumscription about said egress opening and having a slotted channel defined therein, support rods operatively disposed within said slotted channel and depending therefrom; chute means attached to said support rods beneath said exit from and rotatable in said channel to provide a preselected direction of ball return for said chute.

17. A device according to claim 16 in which each said vertical support member comprises an upper portion, a lower portion, and socket means for axially conjoining said upper portion with said lower portion and removably securing it thereto.

18. A device according to claim 17 in which each of said panels is hinged to an adjacent one of said upper portion of said vertical support member.

19. A device according to claim 18 in which each said panel engages an adjacent one of said upper cross frame members when said panel is in said closed position.

20. A basketball training device adapted for use by a dsignated player used while practicing shooting a basketball at a designated hoop, said device comprising: a basket assembly including a base, a vertical support member mounted in said base, a backboard attached to said vertical support in spaced relationship to said base, a designated hoop secured to said backboard and extending outwardly therefrom, and a net depending from said hoop; a support means assembly disposed in spaced circumscribing relationship to said base; enclosure means attached to said support means and coacting with said backboard to define a space about said hoop, said enclosure means having a plurality of panels mounted therein in pivotal relationship to said support means, said panels being selectively pivotable between a first open and a second closed position to respectively permit or deny passage therethrough; collection means attached to and depending from said support means beneath said enclosure means to receive therein a basketball passing into and remaining within said space until drawn by gravity from said space; and adjustable return means operatively disposed beneath said collection means for receiving a basketball therefrom and directing said basketball to said designated player.

* * * * *